US008314650B2

(12) United States Patent
Goto et al.

(10) Patent No.: US 8,314,650 B2
(45) Date of Patent: Nov. 20, 2012

(54) REFERENCE VOLTAGE GENERATING CIRCUIT AND RECEIVER CIRCUIT

(75) Inventors: Takafumi Goto, Tama (JP); Tomomitsu Ohara, Tama (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 58 days.

(21) Appl. No.: 12/943,149

(22) Filed: Nov. 10, 2010

(65) Prior Publication Data

US 2011/0115528 A1 May 19, 2011

(30) Foreign Application Priority Data

Nov. 13, 2009 (JP) ..... 2009-259470

(51) Int. Cl.
*G05F 1/10* (2006.01)

(52) U.S. Cl. ..... 327/542

(58) Field of Classification Search ..... None
See application file for complete search history.

(56) References Cited

U.S. PATENT DOCUMENTS 6,630,859 B1 * 10/2003 Wang ..... 327/539
2005/0017794 A1 * 1/2005 Marotta et al. ..... 327/539

FOREIGN PATENT DOCUMENTS

JP 2003-207527 A 7/2003
JP 2007-318632 A 12/2007

* cited by examiner

*Primary Examiner* — Lincoln Donovan
*Assistant Examiner* — Sibin Chen
(74) *Attorney, Agent, or Firm* — Holtz, Holtz, Goodman & Chick, PC

(57) ABSTRACT

Disclosed is a reference voltage generating circuit including a constant current circuit which comprises: a first resistive element and a bipolar transistor connected in series between a supply voltage terminal and a constant potential point; a first MOS transistor having a gate connected to a node connecting the first resistive element with the bipolar transistor; a second resistive element connected in series between a source of the first MOS transistor and the constant potential point; a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

8 Claims, 5 Drawing Sheets

REFERENCE VOLTAGE GENERATING CIRCUIT AND RECEIVER CIRCUIT

BACKGROUND OF THE INVENTION

1. Field of the Invention

The present invention relates to a reference voltage generating circuit generating reference voltage (comparison voltage) to be supplied to a comparator and more specifically, relates to a technique effectively used in a reference voltage generating circuit less susceptible to fluctuations in supply voltage and temperature, and a receiver circuit including the reference voltage generating circuit.

2. Description of the Related Art

One of the standards for communication between home electric appliances is the home bus system (HBS). In some HBS systems, transmission paths are composed of twisted pair lines, and digital signals are transmitted through the transmission paths using AMI (alternate mark inversion) coded signals (hereinafter, referred to as AMI signals). The AMI signals take three values: zero, positive, and negative values. In a communication using the AMI signals, data is transmitted with logical "0" indicated by zero and logical "1" indicated by alternating the polarity. The transmitted waveform is therefore close to that of an alternating-current signal. Accordingly, the transmission is resistant to noise, and the HBS implements stable data transmission. The polarity of the logical "1" is positive or negative with respect to the electrical potential of the logical "0". The electrical potential of the logical "0" is not limited to 0V and can be 5V or the like, for example.

As the devices which are mounted on the appliances constituting a system to which the HBS is applied and have a function to communicate among the appliances, HBS driver/receiver ICs (semiconductor integrated circuits) have been provided. Such an HBS driver/receiver IC includes a transmission drive circuit configured to generate and send AMI signals to a transmission path. The HBS driver/receiver IC further includes therein a receiver circuit configured to judge the logic level of the AMI signals on the transmission path and regenerate received data. The receiver circuit includes a comparator configured to compare the received signals with a predetermined reference voltage (comparison voltage) for judging the logic level thereof, and a reference voltage generating circuit configured to generate the reference voltage.

The reference voltage generating circuit includes: a constant current circuit configured to output constant current; a bias circuit (constant voltage (reference voltage) circuit) configured to generate bias voltage for the constant current circuit; a current-to-voltage converting circuit configured to convert current generated by the constant current circuit to voltage as the reference voltage; and the like. Such a reference voltage generating circuit is described in Japanese Patent Laid-open Publication No. 2003-207527, for example. Moreover, one of the inventions concerning the receiver circuits in the systems to which the HBS is applied is described in Japanese Patent Laid-open Publication No. 2007-318632, for example.

In the systems to which the HBS is applied, the transmission path may be very long and is, for example, equal to or more than several tens meters in some cases. In such a system, the long transmission path can cause distortion in the waveform of the transmission signal or reduce the amplitude of the signal. In the case where an appliance connected through the HBS includes a load which requires a large amount of power and repeatedly starts and stops like an air conditioner including a compressor, electric current rapidly changes at the start and stop of the load. This can cause fluctuations in the supply voltage. In the receiver circuit, the reference voltage accordingly changes, thus may cause errors in the judgment of the received data.

When the communication between such appliances employs the HBS, therefore, the reference voltage generating circuit used in the receiver circuit is required to generate stable reference voltage even if the supply voltage fluctuates. The inventors conceived a circuit shown in FIG. 5 as the reference voltage generating circuit to be used in the receiver circuit.

The circuit shown in FIG. 5 includes a differential amplifying section 11, a received data judging section 12, and a reference voltage generating section 13. The differential amplifying section 11 receives AMI-coded differential input signals from a transmission path and amplifies the same. The received data judging section 12 compares the signals amplified by the differential amplifying section 11 with reference voltage Vref for judging the received data. The reference voltage generating section 13 generates the reference voltage Vref. The reference voltage generating section 13 includes a constant current circuit having an insulated gate field effect transistors (hereinafter, referred to as MOS transistors) M0 to M3 and resistors R1 and R3. The MOS transistor M0 and resistor R1 are connected in series between a supply voltage terminal VDD and a ground potential point GND. The gate of the MOS transistor M1 is connected to a node N1 connecting the resistor R1 with the MOS transistor M0, and the resistor R3 is connected between the source of the MOS transistor M1 and the ground potential point GND. The MOS transistor M2 is connected to the drain of the MOS transistor M1 and the supply voltage terminal VDD. The MOS transistor M3 forms a current mirror in conjunction with the MOS transistor M2. The gate of the MOS transistor M0 is connected to a node N2 connecting the MOS transistor M1 with the resistor R3. Current I1 of the MOS transistor M2 is thus transferred to the MOS transistor M3 so that constant current I2 flows from the MOS transistor M3.

The constant current I2 flowing from the constant current circuit is transferred by a current mirror circuit composed of MOS transistors M4 and M5 to flow through a resistor R7 for current-to-voltage conversion. The reference voltage Vref based on the supply voltage $V_{DD}$ is thus generated.

In the reference voltage generating circuit as shown in FIG. 5, the current I1 of the MOS transistor M1 of the constant current circuit is determined by the resistance value of the resistor R3 and the potential V2 of the node N2 as I1=V2/R3. Here, the potential V2 of the node N2 is fixed to a potential higher than the ground potential GND by a threshold voltage Vth of the MOS transistor M0. That is to say, the potential V2 is substantially constant, thereby the current I1 flowing through the resistor R3 and MOS transistors M1 and M2 may be made to be constant. Moreover, since the potential V2 is determined based on the ground potential GND, the potential V2 remains substantially constant even if the supply voltage fluctuates. Accordingly, there is little change in the current I1. The current I2, which is proportional to the current I1, and the current I3 flowing through the resistor R7 therefore will not fluctuate. The relative potential of the reference voltage Vref (=I3·R7) to the supply voltage changes little even if the supply voltage fluctuates. The reference voltage generating circuit shown in FIG. 5 thus has an advantage of less dependency on the supply voltage.

In the circuit shown in FIG. 5, however, the potential V2 of the node N2 is determined by the threshold voltage Vth of the MOS transistor M0. The MOS transistor M0 does not have much influence on the potential V2 of the node N2 because the threshold voltage Vth of the MOS transistor M0 has a small temperature coefficient. However, the resistance value of the resistor R3, which is connected to the MOS transistor M1 in series, changes as the ambient temperature changes because of the temperature characteristic of the resistor R3. The current I1 therefore changes comparatively greatly as temperature changes as indicated by a dashed line B1 in FIG. 4A, thus leading to fluctuations in the reference voltage Vref.

In short, in the circuit shown in FIG. 5, the reference voltage Vref changes depending on the ambient temperature. The changes in the reference voltage Vref result in degradation of the receiving sensitivity of the receiver circuit, and the level of the received signal cannot be correctly judged. It is therefore revealed that the circuit shown in FIG. 5 has a problem that more errors will occur in the received data. Herein, the signals supplied from the differential amplifying section 11 to the received data judging section 12 are indicated by Vi1 and Vi2. When Vi1<Vref and Vi2<Vref, the receiving sensitivity is defined by a potential difference between Vi1 and Vi2. The smaller the fluctuations in this potential difference, the better the receiving sensitivity.

SUMMARY OF THE INVENTION

The present invention was made in the light of the aforementioned problems, and an object of the present invention is to provide a reference voltage generating circuit less dependent on the supply voltage and temperature, and to implement a receiver circuit having good receiving sensitivity.

Another object of the present invention is to provide a reference voltage generating circuit which has a circuit configuration capable of easily adjusting the temperature dependence of the reference voltage generated by the reference voltage generating circuit and therefore facilitates designing a receiver circuit with good receiving sensitivity.

According to an aspect of the present invention, there is provided a reference voltage generating circuit including a constant current circuit which comprises:

a first resistive element and a bipolar transistor connected in series between a supply voltage terminal and a constant potential point;

a first MOS transistor having a gate connected to a node connecting the first resistive element with the bipolar transistor;

a second resistive element connected in series between a source of the first MOS transistor and the constant potential point;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

According to another aspect of the present invention, there is provided a receiver circuit, comprising:

a differential amplifying circuit to amplify a pair of AMI-coded input signals;

a received data judging circuit to compare an output of the differential amplifying circuit with a predetermined reference voltage so as to determine a logic level of the input signals; and a reference voltage generating circuit to generate the reference voltage, the reference voltage generating circuit including a constant current circuit which comprises:

a first resistive element and a bipolar transistor connected in series between a supply voltage terminal and a constant potential point;

a first MOS transistor having a gate connected to a node connecting the first resistive element with the bipolar transistor;

a second resistive element connected in series between a source of the first MOS transistor and the constant potential point;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

BRIEF DESCRIPTION OF DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

Hereinbelow, description will be given to preferred embodiments for carrying out the invention, with reference to the drawings.

Figure 1:
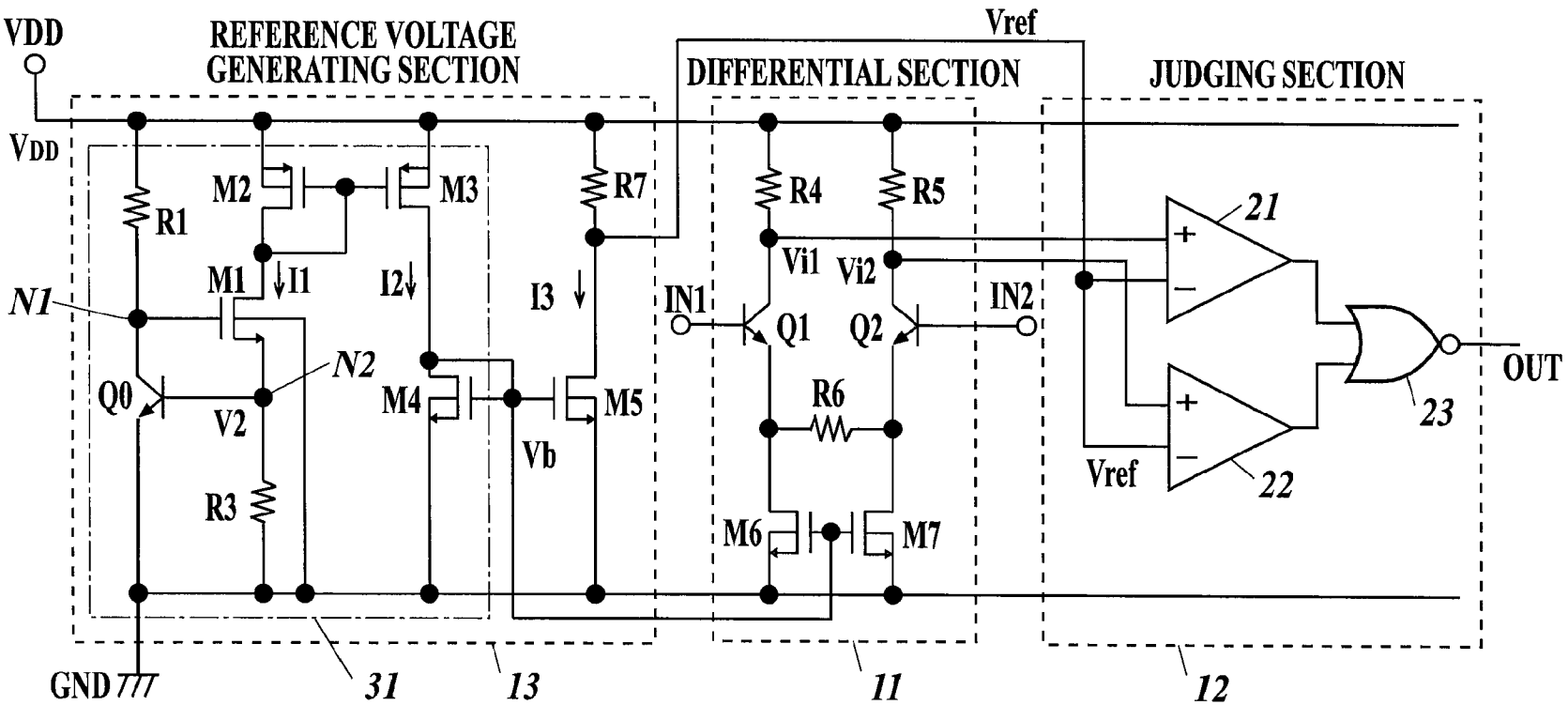
FIG. 1 is a circuit diagram showing a first embodiment of the present invention applied to a receiver circuit incorporated in an HBS driver/receiver IC.

FIG. 1 shows a first embodiment of receiver circuits incorporated in HBS driver/receiver ICs which are mounted on devices constituting a system to which the home bus system (HBS) is applied and have a function to communicate among the devices.

The receiver circuit of the first embodiment includes a differential amplifying section 11, a received data judging section 12, and a reference voltage generating section 13. The differential amplifying section 11 is configured to receive AMI (alternate mark inversion) coded differential input signals from a transmission path and amplify the same. The received data judging section 12 is configured to compare the signals amplified by the differential amplifying section 11 with reference voltage Vref for judging the received data. The reference voltage generating section 13 is configured to generate the reference voltage Vref.

The differential amplifying section 11 includes: a pair of input differential transistors Q1 and Q2 composed of bipolar transistors; load resistors R4 and R5; constant current MOS transistors M6 and M7; and a resistor R6. Bases of the differential transistors Q1 and Q2 are connected to input terminals IN1 and IN2 which are configured to receive the AMI signals, respectively. The load resistors R4 and R5 are connected between collectors of the transistors Q1 and Q2 and a supply voltage terminal VDD, respectively. The constant current MOS transistors M6 and M7 are connected between the ground potential point GND as a constant potential point and emitters of the input differential transistors Q1 and Q2, respectively. The resistor R6 is connected between the emitter terminals of the input differential transistors Q1 and Q2. The input differential transistors Q1 and Q2 may be composed of MOS transistors (insulated gate field effect transistors) instead of bipolar transistors.

The received data judging section 12 includes a pair of comparators 21 and 22 and a NOR gate 23. The comparators 21 and 22 compare differential outputs of the differential amplifying section 11 which are inputted into non-inverting input terminals with the reference voltage Vref inputted to inverting input terminals. The NOR gate 23 receives outputs from the comparators 21 and 22 as inputs. When the pair of AMI signals inputted to the differential amplifying section 11 are at substantially the same level, the comparators 21 and 22 both output low level signals. The received data judging section 12 then outputs a high-level signal (logical "1") from the NOR gate 23. On the other hand, when the pair of AMI signals inputted to the differential amplifying section 11 are signals of different polarities, one of the comparators 21 and 22 outputs high level signals. The received data judging section 12 then outputs a low-level signal (logical "0") from the NOR gate 23. Accordingly, reversing the output of the NOR gate 23 provides proper received data.

The reference voltage generating section 13 includes: a resistor R7 for current-to-voltage conversion and a constant current MOS transistor M5 which are connected in series between the supply voltage terminal VDD and ground potential point GND; and a bias circuit 31 configured to supply gate bias voltage Vb to the constant current MOS transistor M5. The bias voltage Vb outputted from the bias circuit 31 is commonly applied to a gate of the constant current MOS transistor M5 and gates of the constant current MOS transistors M6 and M7 of the differential amplifying section 11 so that currents flowing through the MOS transistors M5 to M7 are determined according to the bias voltage Vb. Specifically, a MOS transistor M4 for current-to-voltage conversion at the output section of the bias circuit 31 and each of the constant current MOS transistors M5 to M7 form a current mirror so that currents flowing through the MOS transistors M5 to M7 are proportional to output current I2 of the bias circuit 31 according to size ratios of the MOS transistor M4 to the MOS transistors M5 to M7, respectively. The MOS transistors M6 and M7 of the differential amplifying section 11 are of the same size.

Figure 5:
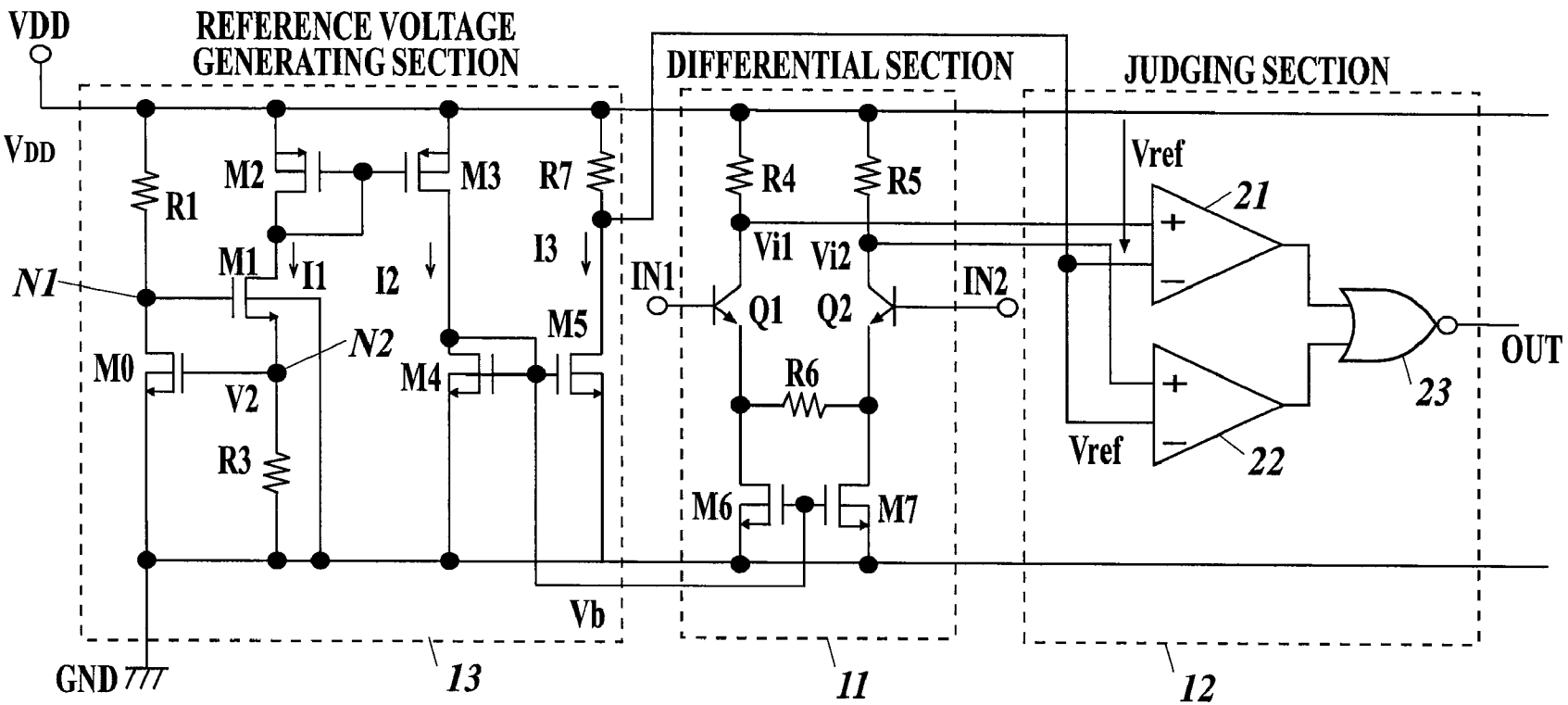
FIG. 5 is a circuit diagram showing a configuration of a reference voltage generating circuit for use in a receiver circuit incorporated in an HBS driver/receiver IC, which was examined prior to arriving at the present invention.

The bias circuit 31 of this embodiment (FIG. 1) is equal to the circuit shown in FIG. 5 except that the N-channel MOS transistor M0 is replaced with an NPN bipolar transistor Q0. The bias circuit 31 includes a constant current circuit having the bipolar transistor Q0, resistors R1 and R3, an MOS transistor M1, and P-channel MOS transistors M2 and M3. The resistor R1 and bipolar transistor Q0 are connected in series between the supply voltage terminal VDD and the ground potential point GND. A gate of the MOS transistor M1 is connected to a node N1 connecting the resistor R1 with the bipolar transistor Q0, and the resistor R3 is connected between a source of the MOS transistor M1 and the ground potential point GND. The MOS transistor M2 is connected between the drain of the MOS transistor M1 and the supply voltage terminal VDD. The MOS transistor M3 forms a current mirror in conjunction with the MOS transistor M2. A base of the bipolar transistor Q0 is connected to a node N2 connecting the MOS transistor M1 with the resistor R3. The current I1 of the MOS transistor M1 is therefore transferred to the MOS transistor M3 with a current mirror formed by the MOS transistors M2 and M3, thus allowing the constant current I2 to flow from the MOS transistor M3.

The constant current I2 flowing from the constant current circuit is converted to voltage as the bias voltage Vb by an N-channel MOS transistor M4 in which a gate and a drain are connected. Current I3 proportional to the constant current I2 is caused to flow through the resistor R7 by the N-channel MOS transistor M5 which forms a current mirror in conjunction with the MOS transistor M4 for current-to-voltage conversion. The reference voltage Vref based on the supply voltage $V_{DD}$ is thus generated.

In this embodiment, the bipolar transistor Q0 is used instead of the MOS transistor M0 in the circuit of FIG. 5. The temperature coefficients of threshold voltages Vth of MOS transistors vary according to the size ratios of W/L of the MOS transistors. Accordingly, in the circuit shown in FIG. 5, the amount of fluctuation in the potential V2 of the node N2 due to temperature is varied because of process variations therein. The temperature characteristic of the current flowing through the first MOS transistor can be varied, and the reference voltage Vref can be therefore varied. On the other hand, in the circuit of FIG. 1, since the temperature coefficient of the voltage $V_{BE}$ between the base and emitter of the bipolar transistor is fixed, the negative temperature characteristic of the resistor R3 can reduce the fluctuations in the current flowing through the MOS transistor M1 due to temperature, thus reducing the changes in reference voltage Vref.

Specifically, if the resistance value of the resistor R3 is reduced because of increased temperature, for example, the current I1 flowing through the resistor R3 tries to increase. However, at this time, the voltage $V_{BE}$ of the bipolar transistor Q0 decreases with the increase in temperature since the voltage $V_{BE}$ of the bipolar transistor Q0 has a negative temperature characteristic. Accordingly, even if the temperature changes, the change in the current I1 flowing through the MOS transistors M2 and M3 is smaller than that in the circuit of FIG. 5. It is therefore possible to reduce the changes in the potential V2 of the node N2 and furthermore reduce the changes in the reference voltage Vref. Moreover, in this embodiment, the constant current MOS transistors M6 and M7 of the differential amplifying section 11 are biased by the stable bias voltage Vb generated by the bias circuit 31. This has an effect on reducing the fluctuations in current of the differential amplifying circuit or in the gain of the differential amplifying circuit due to temperature.

Furthermore, this embodiment is configured to generate the reference voltage Vref based on the supply voltage $V_{DD}$. It is therefore possible to increase the judgment accuracy, that is, the receiving sensitivity of the received data judging section 12. This is because the output level of the differential amplifying section 11 changes in accordance with the changes in the supply voltage $V_{DD}$, however, the reference voltage Vref also changes according to the changes in the supply voltage $V_{DD}$. It is therefore possible to stabilize the relative judgment level regardless of the fluctuations in the supply voltage $V_{DD}$.

Furthermore, an NPN bipolar transistor in a general bipolar IC is composed of a vertical transistor which includes an N-type buried layer serving as a collector region in the semiconductor substrate, and emitter and base regions sequentially formed above the N-type buried layer. In this embodiment, it was confirmed by prototype testing and simulation that fluctuations in the reference voltage Vref can be reduced compared to the case in circuit of FIG. 5 even if the bipolar transistor Q0 is a lateral bipolar transistor which can be formed on a semiconductor chip by a CMOS process as shown in FIG. 2.

Figure 2:
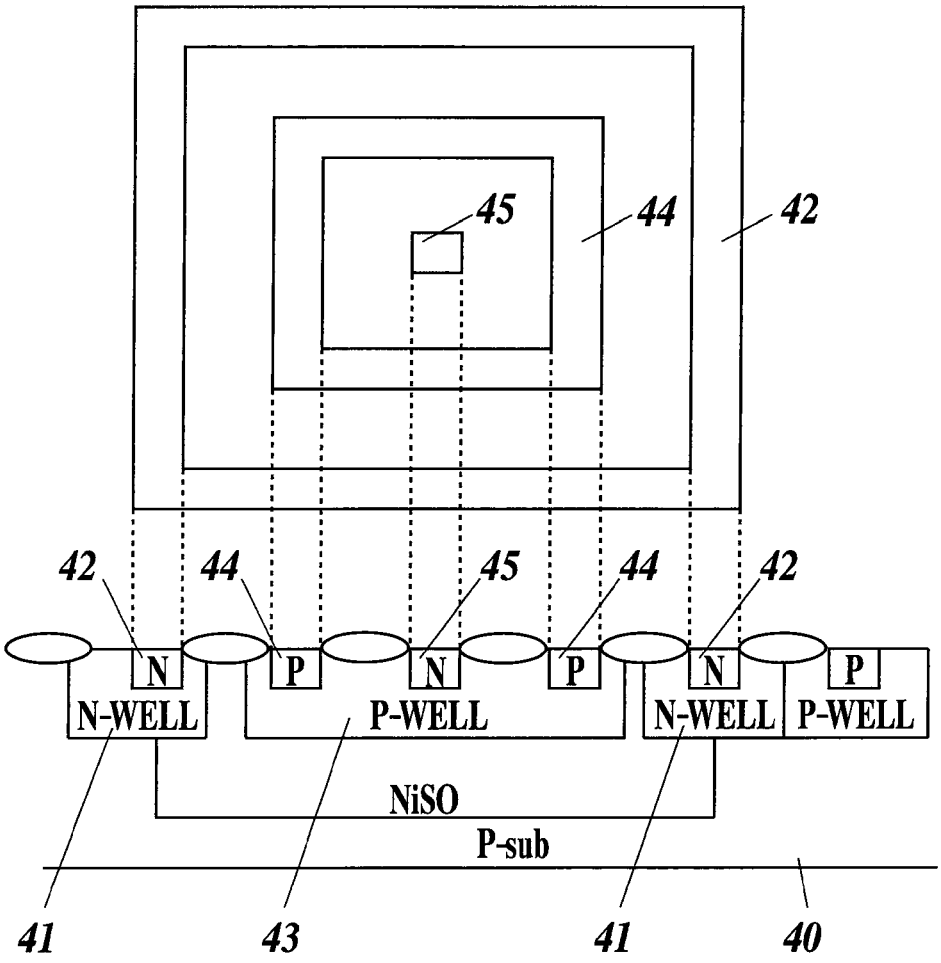
FIG. 2 is a cross-sectional view showing an example of a device structure of a bipolar transistor constituting a reference voltage generating circuit configured to generate reference voltage for use in judgment by a received data judging section in the receiver circuit of the first embodiment.

The bipolar transistor shown in FIG. 2 has the following structure. In a CMOS semiconductor integrated circuit, a collector region of the lateral bipolar transistor is formed by a rectangular ring-shaped N-type region 42 simultaneously formed with the N-type diffusion layer as the source/drain region, on an N-well region 41 in which the source/drain region of an N-channel MOS transistor is formed. Within the N-type region 42 as the collector, the base region of the lateral bipolar transistor is formed by a rectangular ring-shaped P-type region 44 simultaneously formed with a P-type diffusion layer as the source/drain region, on a P-well region 43 in which the source/drain region of a P-channel MOS transistor is formed. Within the P-type region 44 as the base, the emitter region of the lateral bipolar transistor is formed by a rectangular N-type region 45 which is simultaneously formed with the N-type diffusion layer as the source/drain region of the N-channel MOS transistor. Reference numeral 40 indicates a semiconductor chip of monocrystal silicon. A P-type substrate is used in this embodiment, however, an N-type substrate may be used.

In addition to the transistor Q0 constituting the bias circuit 31, the input differential transistors Q1 and Q2 constituting the differential amplifying section 11 may also be composed of lateral bipolar transistors which can be formed on a semiconductor chip by a CMOS process as shown in FIG. 2. According to this embodiment, therefore, the reference voltage generating circuit including the bipolar transistors, and the receiver circuit including the same can be manufactured without using a Bi-CMOS process, which is more complicated than the CMOS process, thus preventing an increase in cost.

Figure 3:
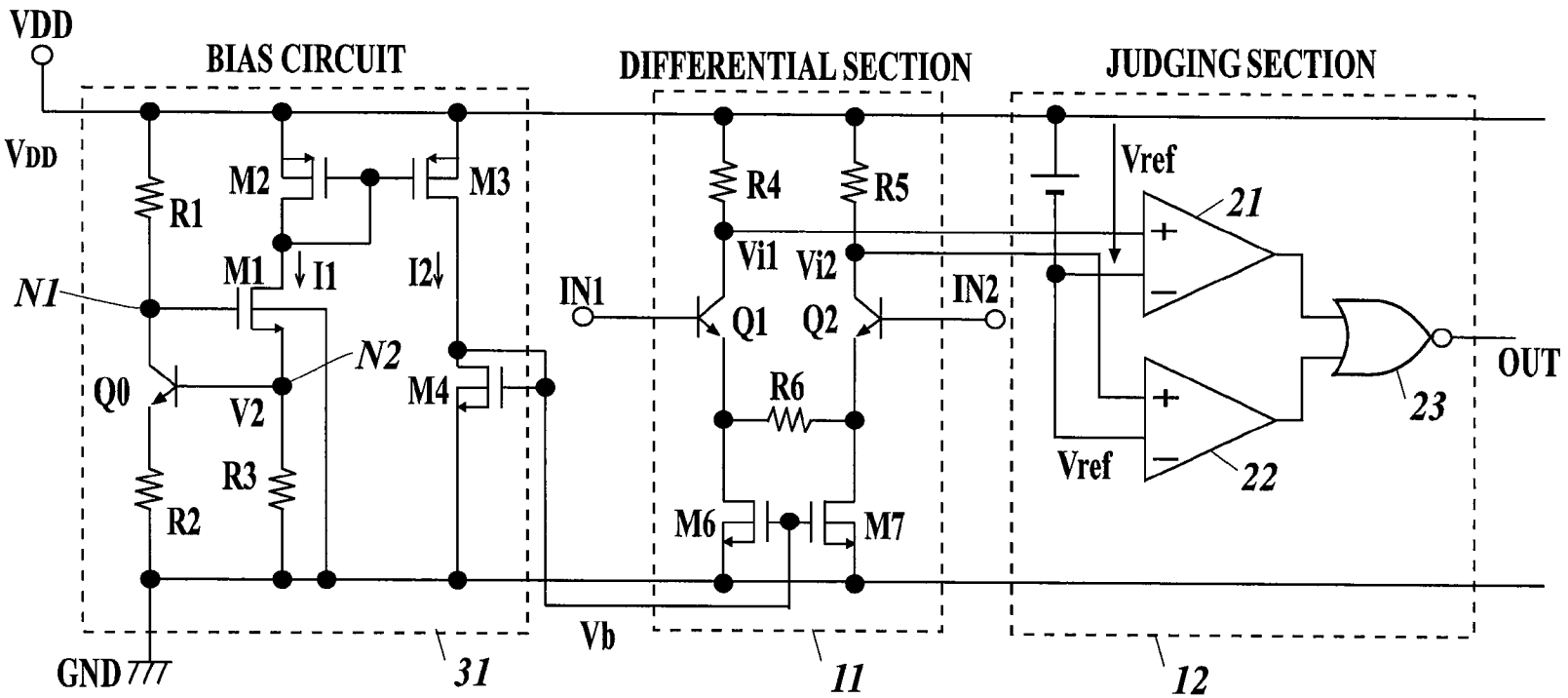
FIG. 3 is a circuit diagram showing a second embodiment of the present invention, which is applied to a receiver circuit incorporated in an HBS driver/receiver IC.

Next, using FIG. 3, a description is given to a second embodiment of the receiver circuit incorporated in the FIBS driver receiver IC to which the present invention is applied.

The receiver circuit of the second embodiment further includes a resistor R2 between the emitter of the bipolar transistor Q0 and the ground potential point GND in the bias circuit 31 of the first embodiment (shown in FIG. 1). In the description of the first embodiment, the fluctuations in the current flowing through the MOS transistor M1 due to temperature can be reduced by the negative temperature characteristic of the resistor R3 since the voltage $V_{BE}$ between the base and emitter of the bipolar transistor has the negative temperature characteristic. However, the change in $V_{BE}$ due to temperature is smaller than that of the resistor R3 and therefore cannot be sufficiently cancelled.

In the second embodiment, the resistor R2 is added between the emitter of the bipolar transistor Q0 and the ground potential point GND. Accordingly, because of the temperature characteristic of the resistor R2, the changes in the potential V2 of the node N2 along with temperature changes can be more easily adjusted than in the circuit of the first embodiment.

In the bias circuit 31 of FIG. 3, collector current Ic flowing through the bipolar transistor Q0, current I0 flowing through the resistor R3, and drain current I1 flowing through the MOS transistors M1 and M2 are expressed as the following Formulae (1) to (3). Herein, $V_{GS}$ denotes voltage between the gate and source of the MOS transistor M1, and $h_{FE}$ denotes a current gain of the bipolar transistor Q0. In addition, $\Delta V_{GS}$, $\Delta V_{BE}$, ΔR2, ΔR3, and $\Delta h_{FE}$ are amounts of changes in $V_{GS}$, $V_{BE}$, R2, R3, and $h_{FE}$ due to the change in temperature, respectively.

$$Ic = \frac{V_{DD} - (V_{GS} + \Delta V_{GS}) - (V_{BE} + \Delta V_{BE})}{(R1 + \Delta R1) + (R2 + \Delta R2)} \tag{1}$$

$$I0 = \frac{I_C \times (R2 + \Delta R2) + (V_{BE} + \Delta V_{BE})}{(R3 + \Delta R3)} \tag{2}$$

$$I1 = I0 + IB = I0 + \frac{I_C}{h_{FE} + \Delta h_{FE}} \tag{3}$$

When $h_{FE}=\infty$ is satisfied in Formula (3), the base current $I_B$ flowing through the transistor Q0 is nearly 0. The following Formula (4) is therefore obtained from Formulae (2) and (3).

$$\begin{aligned} I1 \cong I0 &= \frac{I_C \times (R2 + \Delta R2) + (V_{BE} + \Delta V_{BE})}{(R3 + \Delta R3)} \\ &= \frac{I'_C \times R2 + V_{BE}}{R3} \\ &= \text{setting current value} \end{aligned} \tag{4}$$

$$I'_C = \frac{V_{DD} - V_{GS} - V_{BE}}{R1 + R2} \tag{5}$$

In Formula (4), $V_{BE}$ is the voltage between the base and emitter of the bipolar transistor and is determined by the device characteristic depending on the process. Accordingly, it is possible to reduce the changes in the current I1 flowing through the MOS transistors M1 and M2 due to temperature changes and to provide a desired temperature characteristic for the MOS transistor, by first determining the setting current value and then determining the resistance values of the resistors R1 to R3 so as to satisfy Formula (4) with Ic' substituted with Formula (5).

Figure 4A:
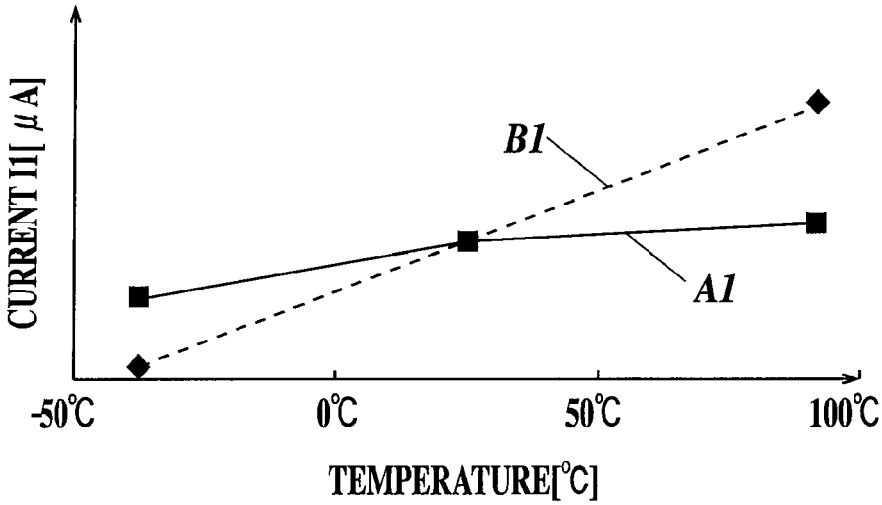
FIG. 4A is a characteristic diagram showing temperature dependency of current flowing through a bias circuit in the reference voltage generating circuit.
Figure 4B:
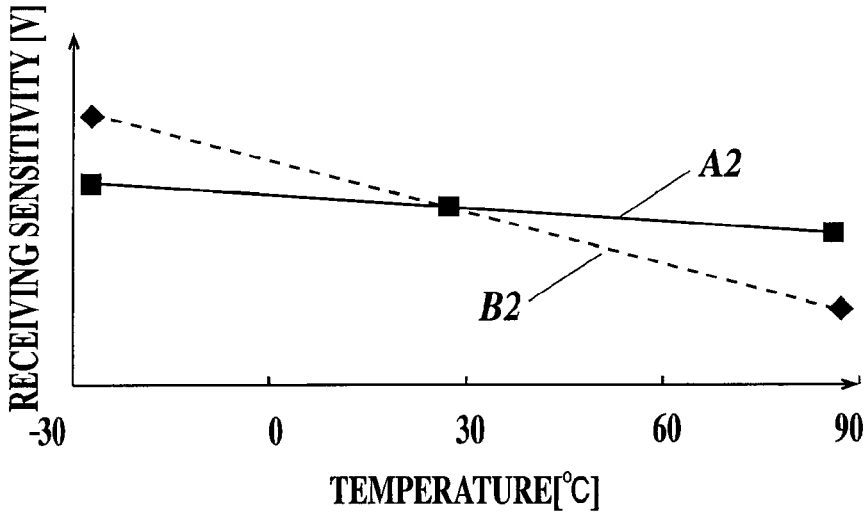
FIG. 4B is a characteristic diagram showing temperature dependency of receiving sensitivity in the receiver circuit including the reference voltage generating circuit according to the embodiments.

As described above, in the circuit of FIG. 5, the current I2 outputted from the bias circuit 31 can significantly change with a change in temperature as indicated by a dashed line B1 in FIG. 4A since the change in temperature causes fluctuation in the potential V2 of the node N2. In the second embodiment, the bipolar transistor Q0 is used instead of the MOS transistor M0 in the circuit of FIG. 5, and the resistor R2 is provided between the emitter of the bipolar transistor Q0 and the ground potential point GND. Accordingly, the change in the potential V2 of the node N2 due to a change in temperature can be made equal to the change in the resistor R2 due to the change in temperature, and the change in the current I2 outputted from the bias circuit 31 can be reduced as indicated by a solid line A1 in FIG. 4A. The receiving sensitivity of the receiver circuit in the circuit shown in FIG. 3 changes little with the change in temperature as indicated by a solid line A2 in FIG. 4B while the receiving sensitivity of the receiver circuit can greatly change in the circuit of FIG. 5 as indicated by the dashed line B2 in FIG. 4B.

Furthermore, the characteristics of the comparators 21 and 22 constituting the received data judging section 12, or the receiving sensitivity could change with the change in ambient temperature because of the temperature characteristics of the elements constituting the circuit of the differential amplifying section 11 or the comparators 21 and 22. According to this embodiment, the output of the bias circuit 31 can be configured to have an arbitrary temperature characteristic. The temperature characteristic of the receiving sensitivity can be therefore further improved by designing the circuit so that the output of the bias circuit 31 has a temperature characteristic capable of cancelling the temperature characteristics of the circuit of the differential amplifying section 11 and the comparators of the received data judging section 12 which are previously examined.

The invention made by the inventor is specifically described above based on the embodiments but is not limited to the above-described embodiments. For example, in the above embodiments, the reference voltage Vref is generated based on the supply voltage $V_{DD}$, and the constant current outputted from the MOS transistor M3 of the bias circuit 31 is transferred by the current mirror (M4 and M5) to flow through the resistor R7 for current-to-voltage conversion. The reference voltage Vref based on the ground potential may be generated by causing the constant current outputted from the MOS transistor M3 of the bias circuit 31 to directly flow through a resistor for conversion to voltage, in another application circuit of the present invention.

Moreover, the above description is mainly given for the cases where the invention made by the inventor is applied to the receiver circuit incorporated in the HBS driver/receiver IC belonging to the field as the background of the invention and to the reference voltage generating circuit used in the receiver circuit. However, the present invention is also applicable to bias circuits generating bias voltage given to constant current circuits.

According to a first aspect of the preferred embodiments of the present invention, there is provided a reference voltage generating circuit including a constant current circuit which comprises:

a first resistive element and a bipolar transistor connected in series between a supply voltage terminal and a constant potential point;

a first MOS transistor having a gate connected to a node connecting the first resistive element with the bipolar transistor;

a second resistive element connected in series between a source of the first MOS transistor and the constant potential point;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

According to the above configuration, the voltage $V_{BE}$ between the base and emitter of the bipolar transistor has a negative temperature characteristic, thereby the potential of the node connecting the first MOS transistor and the second resistive element may be configured to have a negative temperature characteristic because of the negative temperature characteristic of the second resistive element. Accordingly, it is possible to reduce the fluctuations caused by temperature in constant current generated by the constant current circuit, as well as in the reference voltage.

Herein, preferably, a third resistive element is connected between an emitter of the bipolar transistor and the constant potential point. Because of the temperature characteristic of the third resistive element, the change in the potential of the node connecting the first MOS transistor with the second resistive element due to temperature can be made equal to the negative temperature characteristic of the second resistive element. In other words, it is possible to implement a reference voltage generating circuit having a circuit configuration capable of easily adjusting the temperature dependency of the generated reference voltage.

Furthermore, more preferably, the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

The reference voltage generating circuit having the bipolar transistor, and a receiver circuit including the reference voltage generating circuit can be therefore manufactured without using a Bi-CMOS process, which is more complicated than the CMOS process, thus preventing an increase in cost.

According to a second aspect of the preferred embodiments of the present invention, there is provided a receiver circuit, comprising:

a differential amplifying circuit to amplify a pair of AMI-coded input signals;

a received data judging circuit to compare an output of the differential amplifying circuit with a predetermined reference voltage so as to determine a logic level of the input signals; and a reference voltage generating circuit to generate the reference voltage, the reference voltage generating circuit including a constant current circuit which comprises:

a first resistive element and a bipolar transistor connected in series between a supply voltage terminal and a constant potential point;

a first MOS transistor having a gate connected to a node connecting the first resistive element with the bipolar transistor;

a second resistive element connected in series between a source of the first MOS transistor and the constant potential point;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

According to the above configuration, the reference voltage generating circuit generates the reference voltage based on the supply voltage. Accordingly, the relative judgment level of the received data judging circuit can be stabilized regardless of the fluctuations in the supply voltage, thus resulting in a decrease in judging errors of the received data. Moreover, since the voltage $V_{BE}$ between the base and emitter of the bipolar transistor has the negative temperature characteristic, the temperature characteristic of the current flowing through the first MOS transistor can be canceled with the negative temperature characteristic of the second resistive element. This can reduce the fluctuations in the constant current generated by the constant current circuit due to temperature and therefore reduce fluctuations in the reference voltage due to temperature.

Furthermore, preferably, a third resistive element is connected between the emitter of the bipolar transistor and the constant potential point. Because of the temperature characteristic of the third resistive element, the change in the potential of the node connecting the first MOS transistor with the second resistive element due to temperature can be made closer to the negative change of the second resistive element due to temperature. It is therefore possible to implement a reference voltage generating circuit which includes a circuit configuration capable of easily adjusting the temperature dependency of the generated reference voltage and therefore facilitates designing a receiver circuit with good receiving sensitivity.

Still furthermore, preferably, the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

Thereby, the reference voltage generating circuit including a bipolar transistor, and the receiver circuit including the reference voltage generating circuit can be manufactured without using a Bi-CMOS process, which is more complicated than the CMOS process, thus preventing an increase in cost.

According to the present invention, it is possible to implement a reference voltage generating circuit with less dependency on the supply voltage and temperature and therefore implement a receiver circuit with good receiving sensitivity. Moreover, the reference voltage generating circuit is configured to easily adjust the temperature dependency of the reference voltage generated by the reference voltage generating circuit and therefore facilitate designing a receiver circuit with good receiving sensitivity.

The entire disclosure of Japanese Patent Application No. 2009-259470 filed on Nov. 13, 2009 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A reference voltage generating circuit including a constant current circuit which comprises:

a first resistive element, wherein a first end of the first resistive element is connected to a supply voltage terminal, and a second end of the first resistive element is connected to a collector of a bipolar transistor;

a second resistive element which is connected in series between a base of the bipolar transistor and a constant potential point;

a first MOS transistor, wherein a gate of the first MOS transistor is connected to a node between the first resistive element and the collector of the bipolar transistor, and a source of the first MOS transistor is connected to the base of the bipolar transistor;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

2. The reference voltage generating circuit according to claim 1, wherein a third resistive element is connected between an emitter of the bipolar transistor and the constant potential point.

3. The reference voltage generating circuit according to claim 2, wherein the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

4. The reference voltage generating circuit according to claim 1, wherein the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

5. A receiver circuit, comprising:

a differential amplifying circuit to amplify a pair of Alternate Mark Inversion (AMI)-coded input signals;

a received data judging circuit to compare an output of the differential amplifying circuit with a predetermined reference voltage so as to determine a logic level of the input signals; and a reference voltage generating circuit to generate the reference voltage, the reference voltage generating circuit including a constant current circuit which comprises:

a first resistive element and a bipolar transistor connected in series between a supply voltage terminal and a constant potential point;

a first MOS transistor having a gate connected to a node connecting the first resistive element with the bipolar transistor;

a second resistive element connected in series between a source of the first MOS transistor and the constant potential point;

a second MOS transistor connected between a drain of the first MOS transistor and the supply voltage terminal; and a third MOS transistor forming a current mirror in conjunction with the second MOS transistor, wherein a constant current generated by the constant current circuit or a current proportional to the generated constant current is converted to a voltage as a reference voltage.

6. The receiver circuit according to claim 5, wherein a third resistive element is connected between an emitter of the bipolar transistor and the constant potential point.

7. The receiver circuit according to claim 6, wherein the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

8. The receiver circuit according to claim 5, wherein the bipolar transistor comprises:

a collector region and an emitter region formed at a same process as a forming of a source and drain region of an N-channel MOS transistor in a CMOS process; and a base region formed at a same process as a forming of a source and drain region of a P-channel MOS transistor in the CMOS process, and wherein the base region is provided between the collector region and the emitter region.

* * * * *